US005222876A

United States Patent [19]

Budde

[11] Patent Number: 5,222,876

[45] Date of Patent: Jun. 29, 1993

[54] DOUBLE DIAPHRAGM PUMP

[76] Inventor: Dirk Budde, Starenplatz 12, 4018 Langenfeld, Fed. Rep. of Germany

[21] Appl. No.: 768,814

[22] Filed: Sep. 30, 1991

[30] Foreign Application Priority Data

Oct. 8, 1990 [DE] Fed. Rep. of Germany ..... 4031872
Feb. 27, 1991 [DE] Fed. Rep. of Germany ..... 4106180

[51] Int. Cl.[5] ..... F04B 43/06

[52] U.S. Cl. ..... 417/393; 91/275; 251/65; 137/625.65

[58] Field of Search ..... 417/393, 395, 389; 91/275, 341 R, 341 A, 459; 251/65 X; 137/625.69 X

[56] References Cited

U.S. PATENT DOCUMENTS

| | | | |
|---|---|---|---|
| 2,811,979 | 11/1957 | Presnell | 251/65 |
| 3,001,360 | 9/1961 | Budzich | 91/275 |
| 3,192,865 | 7/1965 | Klempay | 417/393 |
| 3,203,439 | 8/1965 | Beckett | 251/65 |
| 3,304,126 | 2/1967 | Rupp | 91/275 |
| 4,406,596 | 9/1983 | Budde | 417/393 |
| 4,509,402 | 4/1985 | Salmonson | 91/341 R |
| 4,889,035 | 12/1989 | Goodnow | 91/275 |

FOREIGN PATENT DOCUMENTS

| | | | |
|---|---|---|---|
| 2925144 | 1/1981 | Fed. Rep. of Germany | 417/393 |
| 3150976 | 6/1983 | Fed. Rep. of Germany . | |
| 3310131 | 9/1989 | Fed. Rep. of Germany . | |
| 3900718 | 7/1990 | Fed. Rep. of Germany . | |
| 2553149 | 10/1983 | France . | |
| 2003976 | 9/1978 | United Kingdom . | |

OTHER PUBLICATIONS

WO-A-8 910 485 2 Nov. 1989 Gyllinder.

*Primary Examiner*—Richard A. Bertsch
*Assistant Examiner*—Peter Korytnyk
*Attorney, Agent, or Firm*—Anderson Kill Olick & Oshinsky

[57] ABSTRACT

A double diaphragm pump having diaphragms connected by a coupling rod and separating two diaphragm chambers, a control spool displaceable in dependence on the position of the diaphragms, with closure means for alternate freeing and closing control passages arranged in a control spool housing for alternate pressurizing and relieving of a driving medium chamber with driving medium, and an actuating member coupled with the diaphragm movement and magnetically with the control spool.

20 Claims, 5 Drawing Sheets

DOUBLE DIAPHRAGM PUMP

TECHNICAL FIELD OF THE INVENTION

The invention relates to a double diaphragm pump having diaphragms connected by a coupling rod and separating two diaphragm chambers, a control spool displaceable in dependence on the diaphragms and an actuating member dependent on the diaphragm movement.

BACKGROUND OF THE INVENTION AND PRIOR ART

A double diaphragm pump of this kind is described in German laid-open patent application 33 10 131. In this double diaphragm pump the actuating member consists of an axially displaceable actuating rod that projects from the control spool housing and is arranged axially in the control spool. This actuating rod acts in both directions on the control spool, which is retained in its end position by means of spring-loaded retaining balls until the force of the springs arranged coaxially on the actuating rod exceeds the retaining force. The control spool then shoots under the spring force into the opposite control position and effects the reversal of the diaphragm movement. In this way the control spool is moved back and forth between two stable end positions.

Since the movement of the control spool is controlled mechanically by the diaphragms, which are rigidly connected together by a coupling rod, and a snap device moves the control spool back and forth between its two end positions using potential energy, this gives rise to the disadvantage that at very low pump power the control spool tends to stick in an intermediate position and at very high pump power fluttering of the spring mechanism makes precise valve control impossible. Moreover a large number of movable parts is required which slide over one another and therefore need suitable lubrication. The spring on the actuating rod is heavily loaded and must as a rule be made of special steel. Even so it has only a limited life, which results in relatively high repair costs. In addition the cost of assembly is relatively high.

To overcome these disadvantages German laid-open specification 33 10 131 proposes replacing the actuating rod which acts directly on the control spool via the spring by a pilot valve which, controlled by the movement of the diaphragm, acts on the control spool, which is in the form of a piston, with pressure medium in alternate directions, so that only small forces are needed to actuate the pilot valve while the control spool itself is displaced by the pressure medium.

This design has the disadvantage that a large number of sealing surfaces are needed, with corresponding friction and leakage losses, and that here too there is the danger of the valve assuming a non-functioning middle position which can bring the pump to a standstill. In addition a certain minimum pressure of the pressure medium is needed to reverse the control spool, so that, particularly in the case of small double diaphragm pumps, it is not possible to operate at pressures less than 2 bar. With this design it is necessary to make a compromise between low losses of pressure medium, with associated sluggishness, and smooth running with the associated losses of pressure medium. In addition this double diaphragm pump makes heavy demands on manufacturing accuracy, is expensive to assemble on account of the large number of individual parts, and has to consist predominantly of metal.

OBJECT OF THE INVENTION

It is an object of the invention to provide a double diaphragm pump that consists of only a few parts, gives rise to no significant internal frictional forces, can be operated from low power to very high power without problems arising, and causes very low losses of pressure medium.

BRIEF DESCRIPTION OF THE INVENTION

According to the invention this problem is solved by magnetically coupling the actuating member or the diaphragms or diaphragm discs of a double diaphragm pump of the kind referred to to the control spool. This coupling can be contactless, so that in this region no friction occurs and no sealing surfaces are needed except where the actuating member is led into the region of the diaphragms.

The actuating member can be coupled with the control spool by means of mutually repelling magnets of like polarity. Alternatively the actuating member can be coupled with the control spool by means of magnets of opposite polarity or by means of one magnet and a ferromagnetic part which attract one another.

Furthermore, one magnet or ferromagnetic part can be arranged on each diaphragm and at least one magnet or ferromagnetic part in the control spool.

It is particularly advantageous to arrange at least one magnet each on the actuating member and on the control spool so that in the opposite end positions like poles face and repel one another.

The magnets can advantageously be in the form of annular magnets.

It is preferred to use permanent magnets that are strong enough to exert the actuating forces and require no external connections.

The actuating member can consist of a rod arranged coaxially in the control spool. This rod can itself be the coupling rod or can consist of an axially displaceable actuating rod projecting through a seal from the control spool and extending parallel to the coupling rod.

Furthermore two magnets can be arranged spaced apart on the actuating member and two spaced apart in the control spool, in each case with unlike poles facing one another, provided the unlike facing poles on the actuating member and in the control spool are the same way round. This tandem arrangement of the pairs of magnets provides a precise switching point, independent of load, with twice the reversing force and stable end positions of the control spool, based on a stable direction of magnetisation.

This arrangement is particularly suitable for relatively small reversing valves. However, if more space is available for larger magnets, so that radial magnetisation is possible, this is preferable, since in this case the actuating forces are greater. The outer faces of the magnets on the actuating member are of the same polarity as the inner faces of the magnets in the control spool.

The double diaphragm pump according to the invention is particularly simple to manufacture if the distances apart of the magnets on the actuating member and in the control spool are the same and, in respect of their distances from stops on the housing, are such that the actuating member and the control spool contact opposed housing stops and, on operation of the actuating member in a given direction of actuation, spring in opposite directions into the opposite position.

The reversing forces at the point of closest approach can be greatly increased if three magnets are arranged spaced apart on the actuating member and three spaced apart in the control spool, in each case with like poles facing one another and with the poles on the actuating member and in the control spool that face one another in the end positions being in each case unlike. The distances apart of the magnets on the actuating member and in the control spool can be the same. In respect of their distance from the housing stops, the magnets can be arranged so that the actuating member and the control spool are in contact with opposed housing stops, with respective pairs of magnets lying in a plane at right angles to the axis of the actuating member, so that, on operation of the actuating member in a given direction of actuation, they spring in opposite directions into the opposite position. This arrangement gives a better distribution of forces over the whole switching path of the control spool and a reserve of force in case the driving air should be contaminated. The attractive interaction of the middle magnets on the actuating member and in the control spool with the respective outer magnets in the end positions results in a very stable, shock-resistant end position of the control spool and of the actuating member.

Three radially magnetised magnets can also be arranged spaced apart on the actuating member and three spaced apart in the control spool. In this case the outer magnets are each of like polarity and have the like poles facing one another, while the middle magnets can either have opposite polarity to them or have like poles facing one another. In the end positions neighbouring magnets on the actuating member and in the control spool then have opposite polarity and attract one another, while the magnets on the actuating member and in the control spool that do not lie opposite to a corresponding magnet repel one another. In the middle position, in which all three radially magnetised pairs of magnets are opposite one another, like poles of each pair of magnets will face one another, so that in this position instantaneous springing over of the actuating member and of the control spool into the respective opposite end position will occur.

The annular permanent magnets on the actuating rod moved by the diaphragms move under the permanent magnets, which are also annular, arranged in the concentric control spool, and repel these in the opposite direction after passing the point of closest approach, so that the control spool is moved in a jump into its opposite working position. The control spool and actuating rod only need to have two movable sealing faces and only one close tolerance face for the control spool acting in the opposite direction. Friction then only occurs on these four sealing faces. Apart from the control spool and the actuating rod there are no other moveable parts, and in addition there is no friction between the actuating rod and the control spool, since these slide into one another without contact. Moreover no losses of pressure medium occur and there is no flow of pressure medium such as occurs with a control spool controlled by a pilot valve, and the reversing force has a constant value independent of the pressure of the pressure medium.

When the pressure medium is compressed air the double diaphragm pump can be operated by a pressure of down to 0.3 bar. The double diaphragm pump is very easy to start and has a substantially higher efficiency compared with pilot-valve-controlled double diaphragm pumps, particularly in the important partly-loaded region.

The double diaphragm pump according to the invention is also little affected by contamination, can operate without lubrication and fatigue, and consequently suffers less wear.

Since the end positions of the control spool correspond to stable end positions of the magnets, magnetic damping at the end position occurs on reversing, with a corresponding reduction in the reversing noise.

The use of mutually repelling permanent magnets ensures an absolutely certain freedom from dead points and constant self-centering of the control spool with very small radial forces. The control spool so to speak swims on its two seals.

The control spool and the actuating rod are particularly simple to produce if they consist of plastics material and the magnets and other metal parts are extrusion-coated with plastic. With this method of production practically no finishing is required. The control spool housing can also be made as an injection moulded plastic part, so that the essential parts of the double diaphragm pump, particularly its movable parts, consist of plastic, and to this extent the pump is metal-free, which is particularly important for use in the semiconductor industry.

BRIEF DESCRIPTION OF THE DRAWINGS

The invention will now be described in more detail, by way of example, with reference to two embodiments shown in the drawings, in which.

DETAILED DESCRIPTION OF PREFERRED EMBODIMENTS OF THE INVENTION

Figure 1:
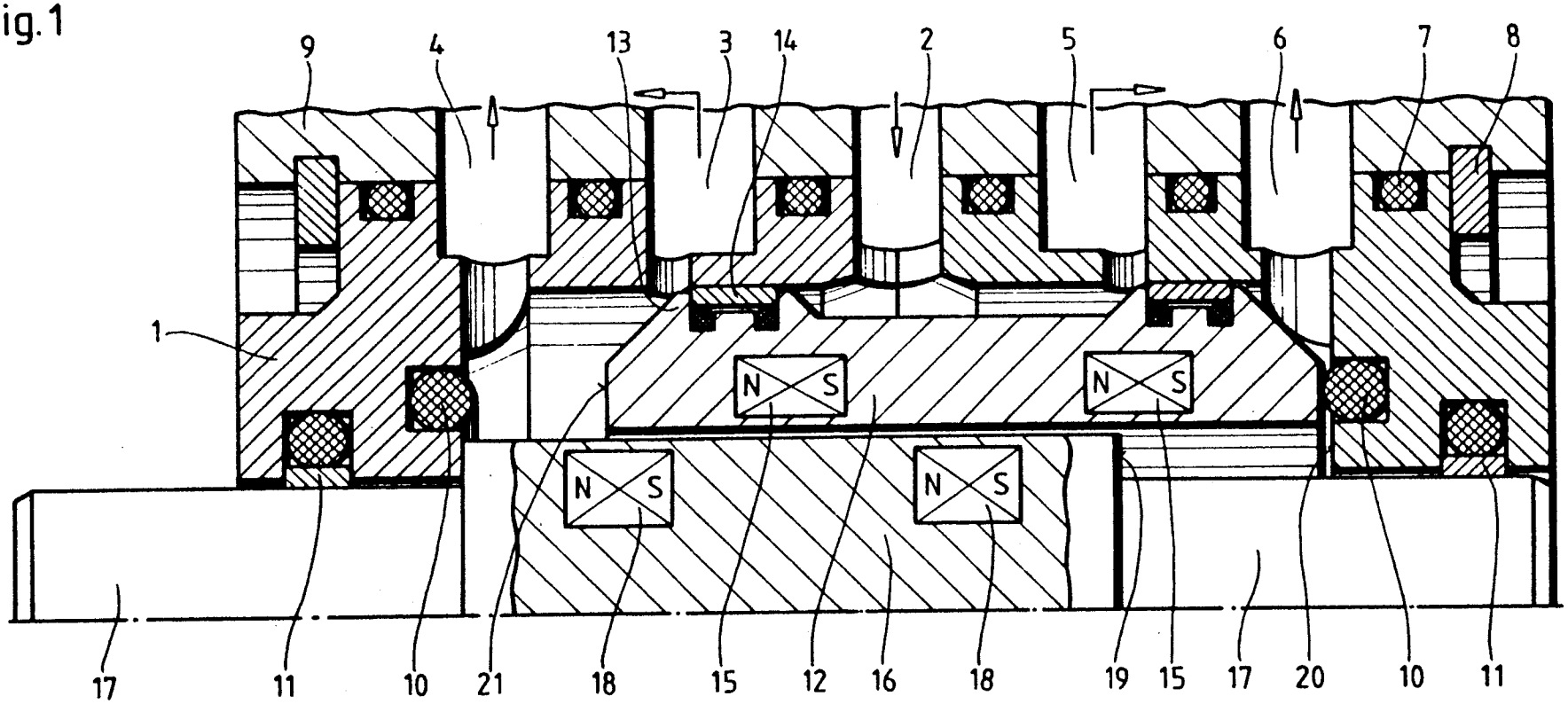
FIG. 1 shows a sectional view of a detail of a double diaphragm pump with a coupling rod and an actuating rod for the control spool.

In FIG. 1 a control spool housing 1 of a double diaphragm pump is shown, with control passages 2, 3, 4, 5, 6. These control passages lead into a reversing block 9. The control passage 2 is connected to a source of pressure, the passage 3 to a driving medium chamber (not shown), the passage 5 to the other driving medium chamber (also not shown, the passage 4 to a driving medium outlet and the passage 6 likewise to a driving medium outlet. As a rule the driving medium used is compressed air. The control passages 2, 3, 4, 5, 6 are sealed from one another and from the exterior by O-ring seals and are fixed in the reversing block by means of circlips 8. In addition, further O-rings are provided in the cover region of the control spool housing 1 which act as damping members for the reciprocating control spool 12. The O-rings 10 and the end faces 21 form respective stop faces.

The control spool 12 can move axially in the housing 1. In the end regions of the control spool 12 there are radially projecting closure members 13 with sliding seals 14.

In the position shown in FIG. 1 there is a connection for one driving medium chamber to the pressure medium supply through the passages 5, 2 and for the other driving medium chamber there is a connection to a pressure medium relief through the passages 3, 4. If the control spool 12 is moved to the left, the driving medium chambers are alternately pressurised and relieved. The control spool 12 consists of plastic and has annular permanent magnets 15 that are injection-coated with plastic. The annular magnets 15 are arranged spaced apart so that their unlike poles adjoin one another, for example north pole on the left and south pole on the right.

In the control spool housing 1 there is also an axially displaceable actuating rod 16 with end pins 17 of smaller diameter, sealed off by means of sliding seals 11. Shoulders 19 on the actuating rod 16 combined with corresponding end faces 20 in the cover region of the control spool housing 1 form stop faces for the movement of the actuating rod 16.

The actuating rod 16 consists of an injection moulded plastic part in which annular magnets 18 are also embedded. These annular magnets 18 are arranged the same distance apart as the annular magnets 15 and likewise have unlike poles facing one another in the same way as the annular magnets 15, i.e. north pole on the left and south pole on the right.

In the position shown all the magnets simultaneously attract one another. The result of this is that the control spool 12 is in a stable end position.

By changing the axial spacing of the two pairs of annular magnets while maintaining the stroke of the control spool and the actuating rod the axial residual force can urge into the end position. Reducing the spacing leads to a resulting attractive force between the control spool and the actuating rod, and increasing it to a repulsive force. These forces can be used either to safeguard the end positions (repulsion) or as braking force for the reversal (attraction).

The control spool 12 and the actuating rod 16 remain in the stable end positions until the actuating rod 16 is displaced to the right and the annular magnets 15, 18 come to coincide. A slight further movement of the actuating rod to the right then suffices to bring the poles of the annular magnets 15, 16 into play so that the control spool 12 shoots suddenly to the left and the actuating rod 16 to the right to reach the stable opposite end position.

Figure 2:
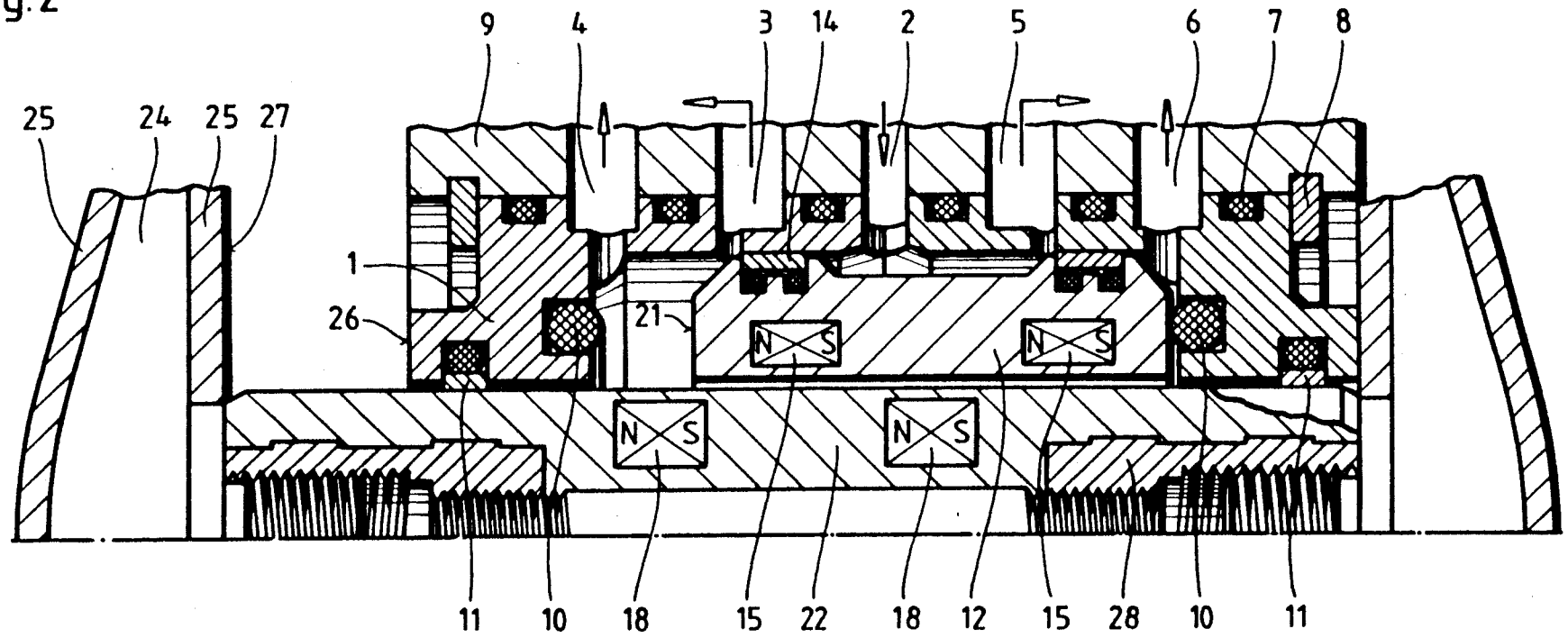
FIG. 2 shows a corresponding sectional view of a detail with a coupling rod as the actuating member; .

In the embodiment shown in FIG. 2 the control spool housing 1 and the control spool are shaped just as in FIG. 1, so that to this extent the same reference numerals can be used. Here, however, the coupling rod 22 serves as actuating rod. Accordingly the control spool housing 1 and the control spool 12 are arranged coaxially to the coupling rod 22. The coupling rod 22 likewise consists of plastic. Annular magnets 18 are correspondingly injection-coated with plastic, as in FIG. 1.

In the end regions of the coupling rods 22 injection-coated sheaths 28 are provided, each serving to strengthen a diaphragm 25 by means of a built-in diaphragm core 24. In this case the outer faces 26 of the control spool housing 1 form stop faces for inner faces 27 of the diaphragms 25. They thus serve to limit the stroke. If the left-hand diaphragm moves to the right with the coupling rod 22, the control spool 12 remains in the position shown until the annular magnet 18 reaches the neighbourhood of the annular magnet 15. At this moment the force of repulsion between the annular magnets 15 and 18 causes the control spool to jump suddenly to the left. In this way, as already described, a reversal of the motion is initiated. The procedure is thus repeated every time the coupling rod reaches the end of its path.

If it is sufficient for the control spool 12 to be carried along without contact by the actuating rod 16 or the coupling rod 22, movement of the control spool 12 and the actuating rod 16 or the coupling rod 22 in opposite directions can be brought about by arranging an annular magnet in the control spool 12 and a ferromagnetic part in the actuating rod 16 or the coupling rod 22. Similarly a further annular magnet can be arranged in the actuating rod 16 or the coupling rod 22 provided its polarity is opposite to that of the annular magnets in the control spool 12.

Figure 3:
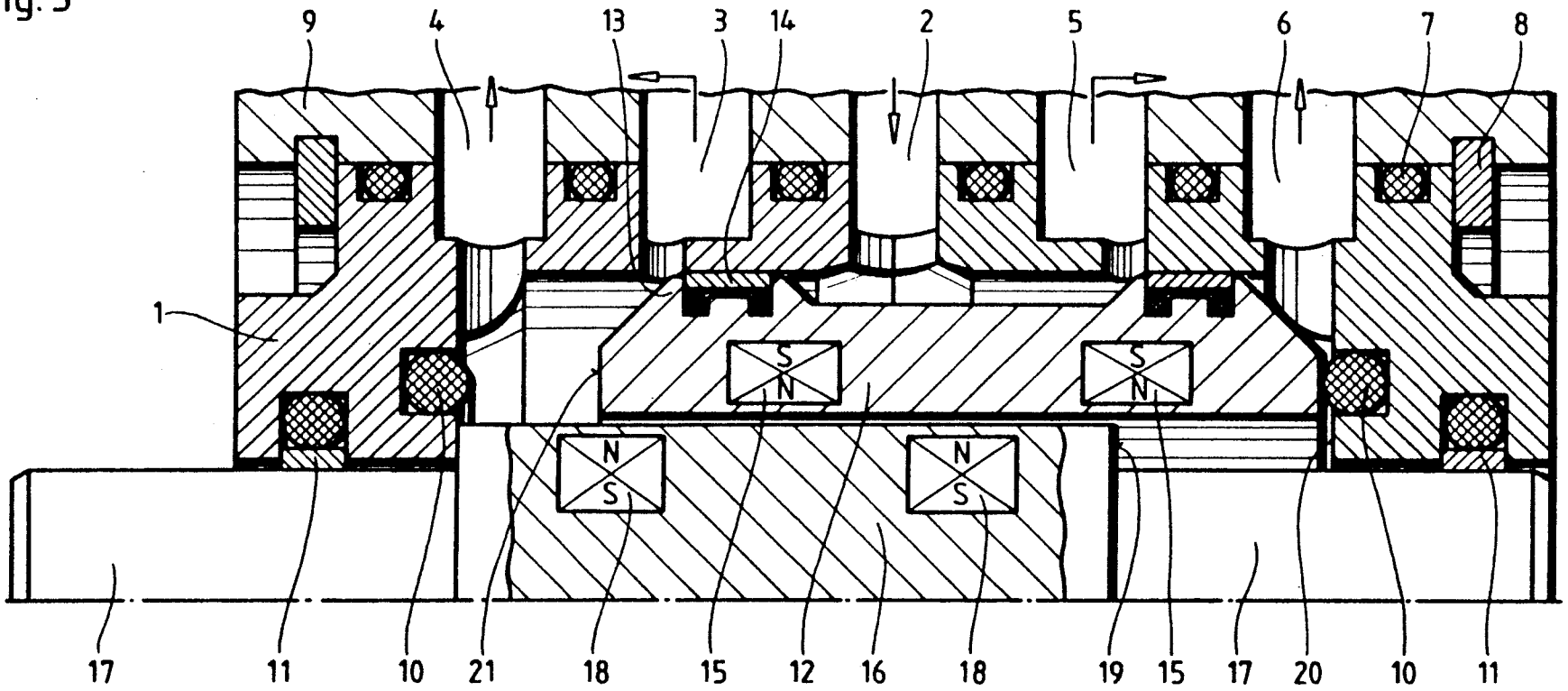
FIG. 3 shows the control spool according to FIG. 1 with the magnets magnetised in a different way.

The control spool shown in FIG. 3 corresponds to the embodiment of FIG. 1, but with radially magnetised inner and outer magnets. This version is particularly suitable for larger control spools, since for the same magnet mass the actuating force is here greater than in the case of axial magnetisation.

Figure 4:
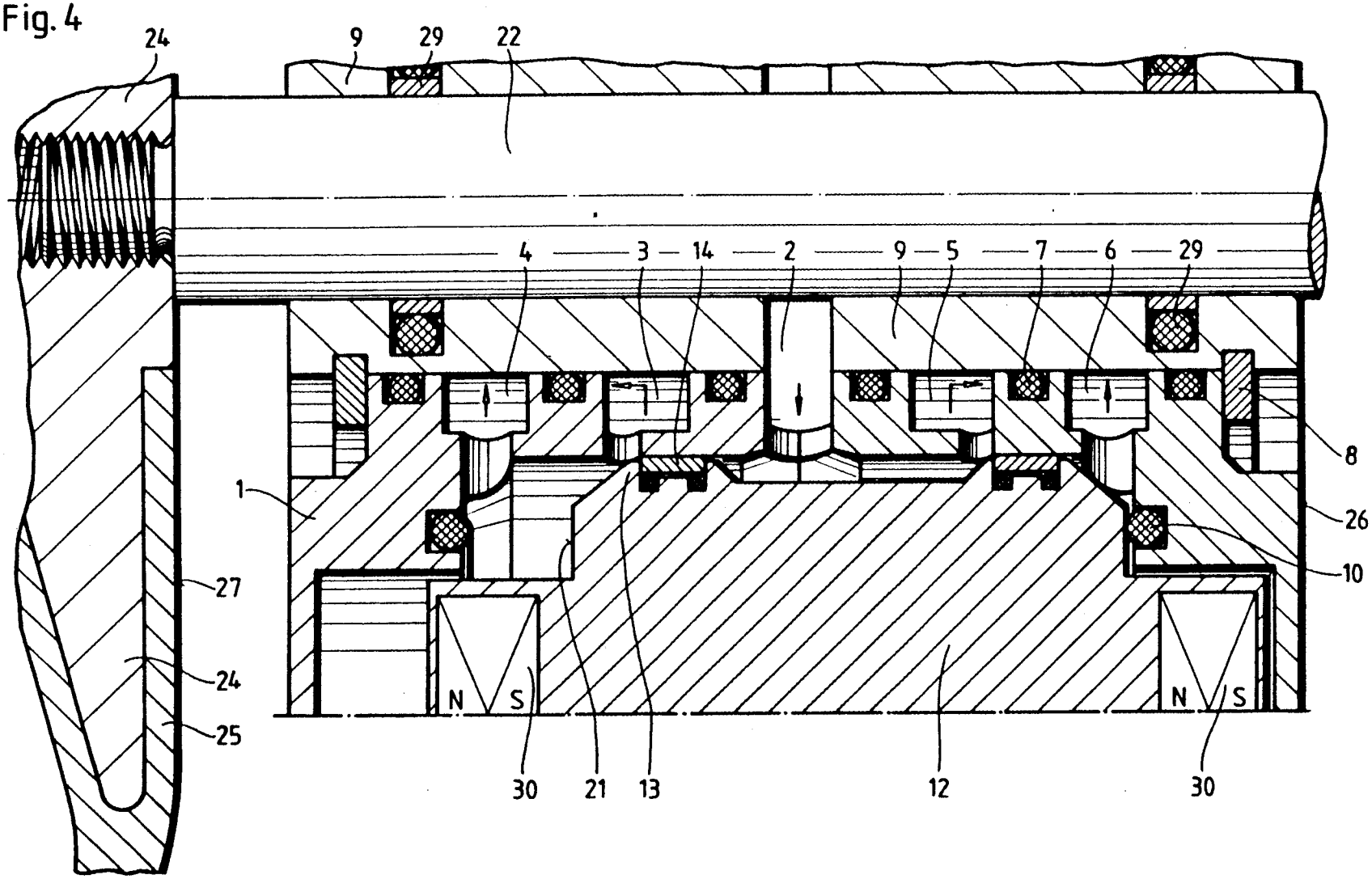
FIG. 4 shows a control spool with magnets on the end faces of the valve spool.

The reversal of the control spool can also be effected, as shown in FIG. 4, by the means of correspondingly strong axially acting magnets 30 on the end faces of the control spool 12 that cooperate directly with a ferromagnetic diaphragm armature or diaphragm disc 25 and initiate the reversal by attraction when they approach a diaphragm. The actuating rod then also becomes superfluous. The side wall of the control spool housing is then made as thin as possible.

In the case of the embodiment of FIG. 4 the coupling rod 22 is also provided with two seals 29, on either side of the control passage 2. The course of the control passage 2 then permits cooling of the coupling rod, which is preferably guided in a block 9 of plastic.

Figure 5:
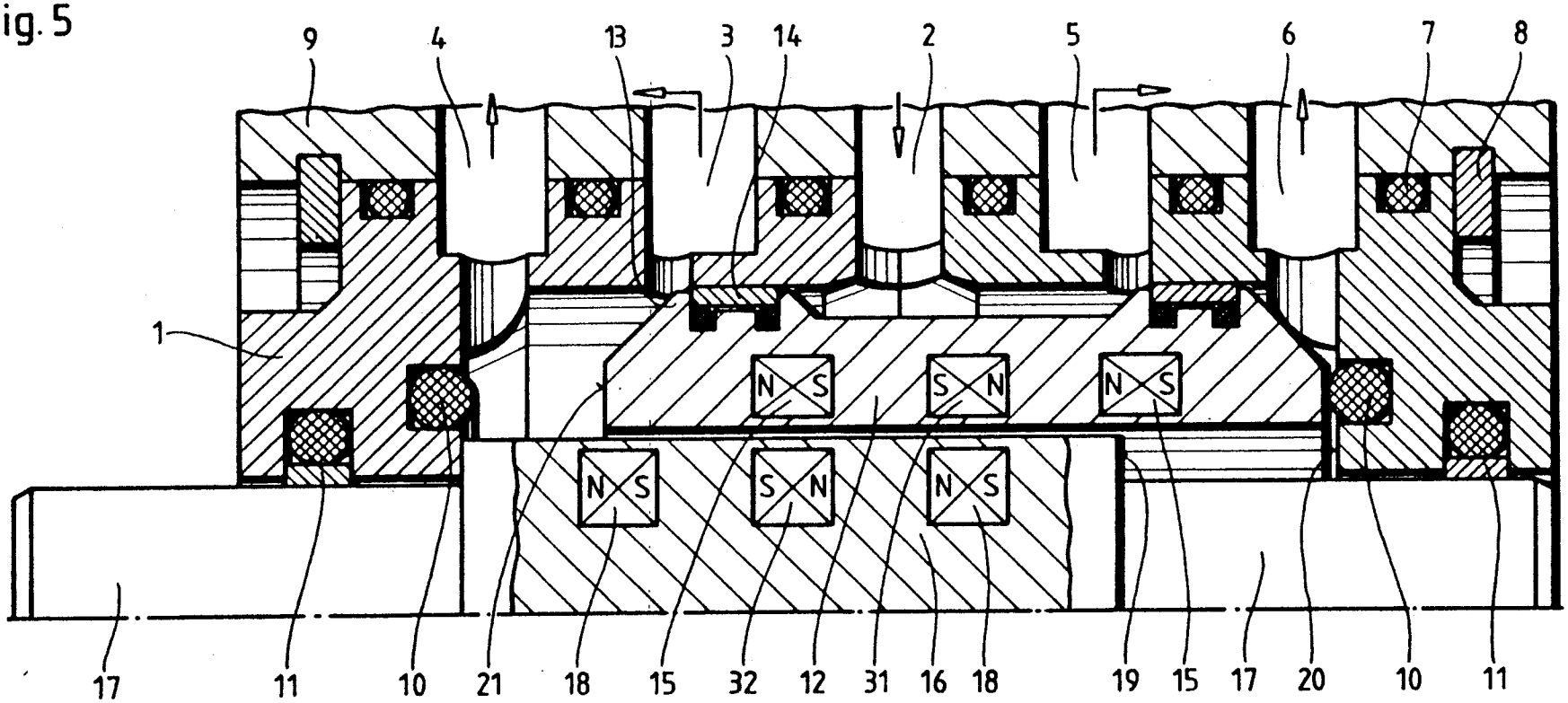
FIG. 5 shows a double diaphragm pump corresponding to FIG. 1 except that it has three magnets each on the actuating member and in the valve spool.

In the case of the embodiment of FIG. 5 three magnets 15, 31; 18, 32, spaced apart, are arranged on the actuating member 16, 17 and three in the control spool 12. The magnets 15, 31 in the control spool 12 and the magnets 18, 32 on the actuating member 16, 17 are arranged so that like poles face one another.

The spacings of the magnets 15, 31 in the control spool 12 and the magnets 18, 32 on the actuating member 16, 17 are in each case the same. The magnets 15, 31 are arranged with their distances from the housing stops 10 such that the actuating member 16, 17 and the control spool 12 are in contact with opposite housing stops 10 and that in each case two pairs of magnets 15, 32; 31, 18 lie in a plane at right angles to the axis of the actuating member 16, 17, and on actuation of the actuating member 16, 17 in a predetermined direction of actuation they spring over counter to one another into the opposite end position.

The magnets 15, 31; 18, 32 may also be magnetised radially, as shown in FIG. 3. In this case the middle magnets 31, 32 are in each case of opposite polarity to the outer magnets 15, 18, so that in the end positions in each case magnets 15, 32 and 31, 18 of opposite polarity are opposite one another and thereby define a stable end position, while on switching over in the middle position the magnets 15, 18; 31, 32 and again 15, 18 are opposite to one another, like poles are facing one another and bring about immediate springing over into the opposite end position.

What is claimed is:

1. A double diaphragm pump, comprising two spaced diaphragms separating two diaphragm chambers and displaceable between respective end positions; a coupling rod for connecting said two diaphragms; a control spool for controlling flow of a medium to and from said double diaphragm pump; and an actuating member magnetically coupled with said control spool for switching a position of said control spool at a respective end position of a respective diaphragm to reverse a displacement direction of said diaphragms.

2. A double diaphragm pump according to claim 1, wherein the actuating member is coupled with the control spool by means of mutually repelling magnets of like polarity.

3. A double diaphragm pump according to claim 1, wherein the actuating member is coupled with the control spool by means of magnetic pair selected from the group consisting of mutually attracting magnets of opposite polarity and a magnet and a ferromagnetic part.

4. A double diaphragm pump according to claim 3, wherein one member of said pair is arranged on each diaphragm and at least one of the other member is arranged on the control spool.

5. A double diaphragm pump according to claim 1, wherein the magnetic coupling includes at least one permanent magnet.

6. A double diaphragm pump according to claim 1, wherein the actuating member consists of a rod arranged axially in the control spool.

7. A double diaphragm pump according to claim 6, wherein the coupling rod is arranged coaxially in the control spool.

8. A double diaphragm pump according to claim 6, wherein the control spool is parallel to the coupling rod and the actuating member projects axially displaceable from the control spool housing.

9. A double diaphragm pump according to claim 6, wherein on the actuating member and in the control spool, respectively, at least one magnet each is arranged so that like poles of said magnets lie opposite one another in the opposite end positions.

10. A double diaphragm pump according to claim 9, wherein the magnets are annular magnets.

11. A double diaphragm pump according to claim 9, wherein two magnets are arranged spaced apart on the actuating member and two spaced apart in the control spool, with unlike poles facing one another, and the facing unlike poles on the actuating member and in the control spool are respectively of opposite polarity.

12. A double diaphragm pump according to claim 11, wherein the distances apart of the magnets on the actuating member and in the control spool are the same and are such, in respect of their distance from stops in the housing, that the actuating member and the control spool are in contact with opposite housing stops and, on actuation of the actuating member, spring over into the oppose position after a predetermined actuation path.

13. A double diaphragm pump according to claim 9, wherein three magnets are arranged spaced apart on the actuating member and three spaced apart in the control spool, in each case with like poles facing one another, with the poles on the actuating member and in the control spool that face one another in the end positions being unlike.

14. A double diaphragm pump according to claim 13, wherein the distances apart of the magnets on the actuating element and in the control spool are the same, the magnets are so arranged, in respect of their distance from the housing stops, that the actuating member and the control spool are in contact with opposite housing stops, with in each case two pairs of magnets lying in a plane at right angles to the axis of the actuating member, and the actuating member and the control spool jump in opposite direction to the opposite end positions after actuation of the actuation member through a predetermined distance.

15. A double diaphragm pump according to claim 9, wherein three radially magnetised magnets are arranged spaced apart on the actuating member and three spaced apart in the control spool, in each case the outer magnets being each of like polarity and having like poles facing one another, while the middle magnets can either have opposite polarity to them or have like poles facing one another, and the neighboring magnets on the actuating member and in the control spool in the end positions having opposite polarity.

16. A double diaphragm pump according to claim 1, wherein at least one of the control spool and the actuating member is of plastic.

17. A double diaphragm pump according to claim 16, wherein at least one of the magnets and the ferromagnetic material is injection-coated with plastic.

18. A double diaphragm pump, comprising two spaced diaphragms separating two diaphragm chambers and displaceable between respective end positions; a coupling rod for connecting said two diaphragms; and a control spool for controlling flow of a medium to and from said double diaphragm pump; said two diaphragms being magnetically coupled with said control spool for switching a position of said control spool at a respective end position of a respective diaphragm to reverse a displacement direction of said diaphragms.

19. A double diaphragm pump according to claim 18, wherein the control spool is provided with magnets at its end faces and the diaphragms are provided with a ferromagnetic core.

20. A double diaphragm pump according to claim 18, wherein each of said two diaphragms comprises a diaphragm disc, said control spool being magnetically coupled with said diaphragm discs.

* * * * *